US009574409B2

(12) United States Patent
Briscoe et al.

(10) Patent No.: US 9,574,409 B2
(45) Date of Patent: Feb. 21, 2017

(54) STABILIZER ASSEMBLY FOR WIRED DRILL PIPE COUPLING

(71) Applicant: INTELLISERV, LLC, Houston, TX (US)

(72) Inventors: Michael A. Briscoe, Lehi, UT (US); Scott Dahlgren, Alpine, UT (US)

(73) Assignee: Intelliserv, LLC, Houston, TX (US)

( * ) Notice: Subject to any disclaimer, the term of this patent is extended or adjusted under 35 U.S.C. 154(b) by 430 days.

(21) Appl. No.: 14/170,341

(22) Filed: Jan. 31, 2014

(65) Prior Publication Data

US 2015/0218893 A1 Aug. 6, 2015

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 17/04; E21B 17/042
USPC ..... 166/380; 175/56
See application file for complete search history.

(56) References Cited

U.S. PATENT DOCUMENTS 4,576,402 A 3/1986 Murray et al.
4,997,048 A 3/1991 Isom
2005/0161215 A1* 7/2005 Hall ..... E21B 47/01 166/242.6
2011/0100643 A1* 5/2011 Themig ..... E21B 34/102 166/373
2013/0140029 A1* 6/2013 Sullivan ..... E21B 17/021 166/305.1

FOREIGN PATENT DOCUMENTS

GB 2294068 A 4/1996
WO 2006/083764 A1 8/2006

OTHER PUBLICATIONS

United Kingdom Application No. GB1414870.4 Combined Search and Examination Report dated Jan. 12, 2015, 5 pages.

* cited by examiner

*Primary Examiner* — Taras P Bemko
(74) *Attorney, Agent, or Firm* — Conley Rose, P.C.

(57) ABSTRACT

A downhole sub having a first tubular housing with a first internal shoulder, a second tubular housing with a second internal shoulder, and a stabilizer assembly to be disposed between the first and second internal shoulders. The first and second tubular housings are configured to be threaded together, and the stabilizer assembly is configured to engage the first and second internal shoulders. A method of coupling tubular housings in a downhole sub in which a first tubular housing and a second tubular housing are threadably coupled, where the first tubular housing includes a first shoulder and the second tubular housing includes a second shoulder. A sleeve is interlocked with and inside the second tubular housing such that the sleeve is disposed between the first and second shoulders and includes a third shoulder, where the first shoulder is torqued against the third shoulder.

27 Claims, 9 Drawing Sheets

REPLACEMENT SHEET

7/9

STABILIZER ASSEMBLY FOR WIRED DRILL PIPE COUPLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

In downhole drilling operations, downhole measuring tools are used to gather information about geological formations, status of downhole tools, and other downhole conditions. Such data is useful to drilling operators, geologists, engineers, and other personnel located at the surface. This data may be used to adjust drilling parameters, such as drilling direction, penetration speed, and the like, to effectively tap into an oil or gas bearing reservoir. Data may be gathered at various points along the drill string, such as from a bottom-hole assembly or from sensors distributed along the drill string. Once gathered, apparatus and methods are needed to rapidly and reliably transmit the data to the surface. Traditionally, mud pulse telemetry has been used to transmit data to the surface. However, mud pulse telemetry is characterized by a very slow data transmission rate (typically in a range of 1-6 bits/second) and is therefore inadequate for transmitting large quantities of data in real time. Other telemetry systems, such as wired pipe telemetry system and wireless telemetry system, have been or are being developed to achieve a much higher transmission rate than possible with the mud pulse telemetry system.

In wired pipe telemetry systems, inductive transducers are provided at the ends of wired pipes. The inductive transducers at the opposing ends of each wired pipe are electrically connected by an electrical conductor running along the length of the wired pipe. Data transmission involves transmitting an electrical signal through an electrical conductor in a first wired pipe, converting the electrical signal to a magnetic field upon leaving the first wired pipe using an inductive transducer at an end of the first wired pipe, and converting the magnetic field back into an electrical signal using an inductive transducer at an end of the second wired pipe. Several wired pipes are typically needed for data transmission between the downhole location and the surface. As is known, the signal coupler or junction between ends of the wired pipe can include other types of electrical couplers beyond inductive transducers, such as direct conductive-type couplers and others. However, the use of a unitary double-shouldered connection typically only allows for an electronics assembly that greatly restricts the inner diameter of the tool. The wired pipes may be subjected to temperatures up to 200° C. and 25,000 psi pressure.

BRIEF SUMMARY OF THE DISCLOSURE

In one embodiment, a downhole sub includes a first tubular housing with a first internal shoulder, a second tubular housing with a second internal shoulder, and a stabilizer assembly to be disposed between the first and second internal shoulders. In addition, the first and second tubular housings are configured to be threaded together. Moreover, the stabilizer assembly is configured to engage the first and second internal shoulders. In some embodiments, the stabilizer assembly includes an outer sleeve and an inner spacer. The outer sleeve may include a first end opposite a second end, wherein the first end is disposed proximate the second internal shoulder of the second housing. The second end of the outer sleeve may form a third internal shoulder. The first internal shoulder may be configured to engage the third internal shoulder such that the engagement of the first internal shoulder and the third internal shoulder provides a torquing interface between the first and second tubular housings.

In another aspect, a downhole sub includes a first tubular housing with a first internal shoulder, a second tubular housing with a second internal shoulder, and a sleeve to be disposed between the first and second internal shoulders. In addition, the first and second tubular housings are configured to be threaded together. Moreover, the sleeve is configured to engage the first and second internal shoulders.

In a further aspect, a downhole sub includes a first tubular housing with a first internal shoulder, a second tubular housing with a second internal shoulder, and a spacer having a first end that is biased and a second end configured to engage the second internal shoulder. Moreover, the first and second tubular housings are configured to be threaded together.

In one embodiment, a method for stabilizing an assembly for use with a downhole sub assembly includes an outer sleeve having a plurality of interlocking interfaces, an inner spacer having a first annular end opposite a second annular end, a cutout and a coupler element disposed in a channel on a the first annular end, and a biasing assembly comprising a biasing element and disposed about and retained by a first end of a spring cap. Moreover, the inner spacer is configured to engage and retain the biasing element at a second annular end of the spring cap.

In one embodiment of a method for coupling tubular housings in a downhole sub, the method includes threadably coupling a first tubular housing and a second tubular housing, wherein the first tubular housing includes a first shoulder and the second tubular housing includes a second shoulder. In addition, the method comprises interlocking a sleeve with and inside the second tubular housing, the sleeve disposed between the first and second shoulders and including a third shoulder. Moreover, the method comprises torquing the first shoulder against the third shoulder.

Embodiments described herein comprise a combination of features and advantages intended to address various shortcomings associated with certain prior devices, systems, and methods. The foregoing has outlined rather broadly the features and technical advantages of the disclosure such that the detailed description of the disclosure that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the disclosure. It should also be realized by those skilled in the art that such equivalent constructions do not depart from the spirit and scope of the disclosure as set forth in the appended claims.

BRIEF DESCRIPTION OF THE DRAWINGS

For a detailed description of the preferred embodiments, reference will now be made to the accompanying drawings in which.

DETAILED DESCRIPTION

Figure 1:
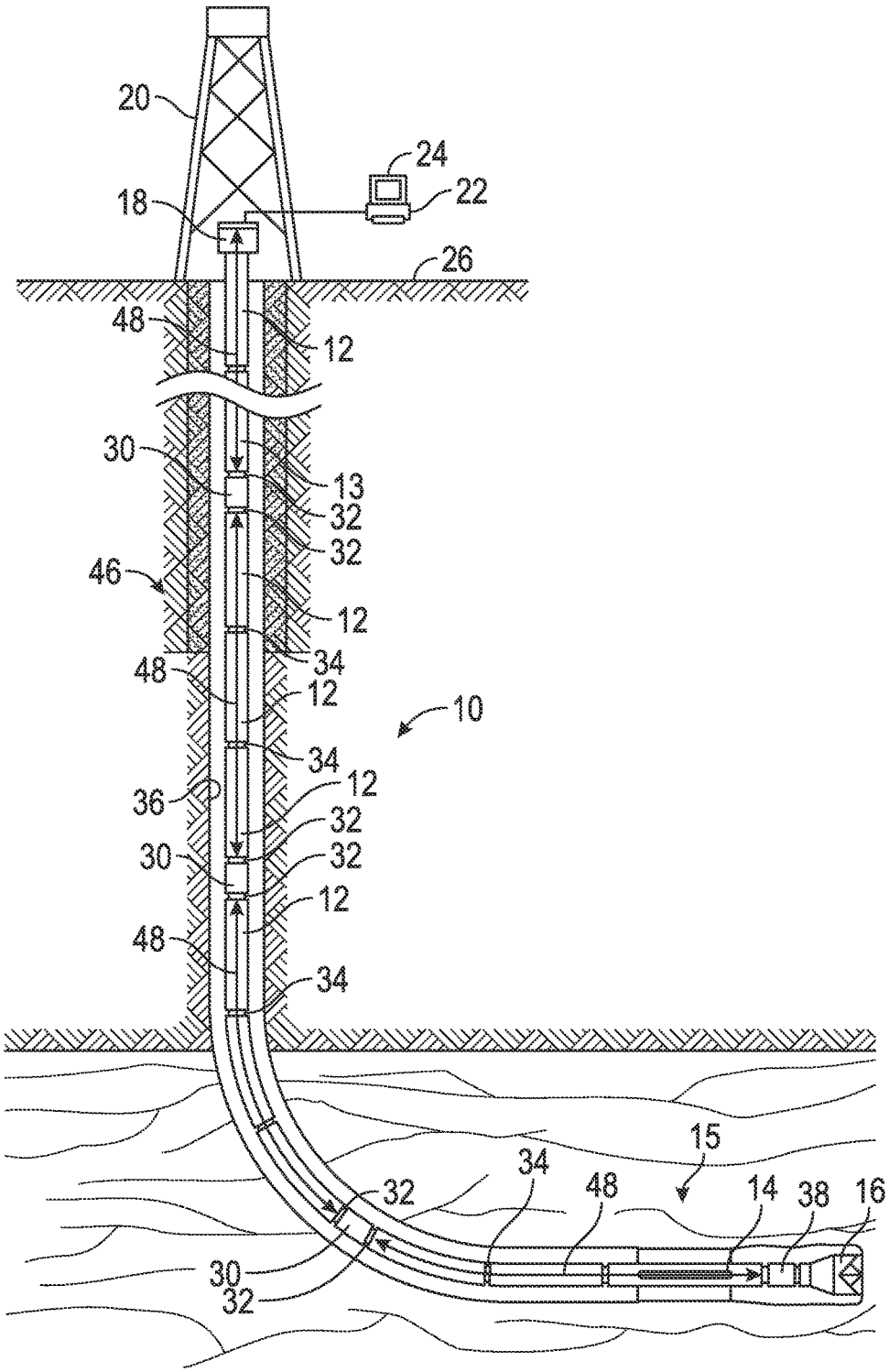
FIG. 1 is a schematic view of a drilling system including an embodiment of a system in accordance with the principles described herein

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosures, including the claims, is limited to that embodiment.

Certain terms are used throughout the following description and claim to refer to particular system components. This document does not intend to distinguish between components that differ in name but not function. Moreover, the drawing figures are not necessarily to scale. Certain features of the disclosure may be shown exaggerated in scale or in somewhat schematic form, and some details of conventional elements may not be shown in the interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Still further, reference to "up" or "down" may be made for purposes of description with "up," "upper," "upward," or "above" meaning generally toward or closer to the surface of the earth, and with "down," "lower," "downward," or "below" meaning generally away or further from the surface of the earth.

FIG. 1 illustrates a drilling operation 10 in which a borehole 36 is being drilled through subsurface formation beneath the Earth's surface 26. The drilling operation includes a drilling rig 20 and a drill string 13 having central axis 11 (shown in FIG. 2). The drill string 13 includes coupled tubulars or drill pipe 12 and extends from the rig 20 into the borehole 36. A bottom hole assembly (BHA) 15 is provided at the lower end of the drill string 13. The BHA 15 may include a drill bit or other cutting device 16, a bit sensor package 38, and a directional drilling motor or rotary steerable device 14, as shown in FIG. 1.

The drill string 13 preferably includes a plurality of network nodes 30. The nodes 30 are provided at desired intervals along the drill string. Network nodes essentially function as signal repeaters to regenerate data signals and mitigate signal attenuation as data is transmitted up and down the drill string. The nodes 30 may be integrated into an existing section of drill pipe or a downhole tool along the drill string. A repeater for this purpose is disclosed in U.S. Pat. No. 7,224,288 (the "'288 Patent"), which is incorporated herein by reference. Sensor package 38 in the BHA 15 may also include a network node (not shown separately). For purposes of this disclosure, the term "sensors" is understood to comprise sources (to emit/transmit energy/signals), receivers (to receive/detect energy/signals), and transducers (to operate as either source/receiver). Connectors 34 represent drill pipe joint connectors, while the connectors 32 connect a node 30 to an upper and lower drill pipe joint.

The nodes 30 comprise a portion of a downhole electromagnetic network 46 that provides an electromagnetic signal path that is used to transmit information along the drill string 13. The downhole network 46 may thus include multiple nodes 30 based along the drill string 13. Communication links 48 may be used to connect the nodes 30 to one another, and may comprise cables or other transmission media integrated directly into sections of the drill string 13. The cable may be routed through the central borehole of the drill string 13, or routed externally to the drill string 13, or mounted within a groove, slot or passageway in the drill string 13. Preferably signals from the plurality of sensors in the sensor package 38 and elsewhere along the drill string 13 are transmitted to the surface 26 through a wire conductor 48 along the drill string 13. Communication links between the nodes 30 may also use wireless connections.

A plurality of packets may be used to transmit information along the nodes 30. Packets may be used to carry data from tools or sensors located downhole to an uphole node 30, or may carry information or data necessary to operate the network 46. Other packets may be used to send control signals from the top node 30 to tools or sensors located at various downhole positions.

Figure 2:
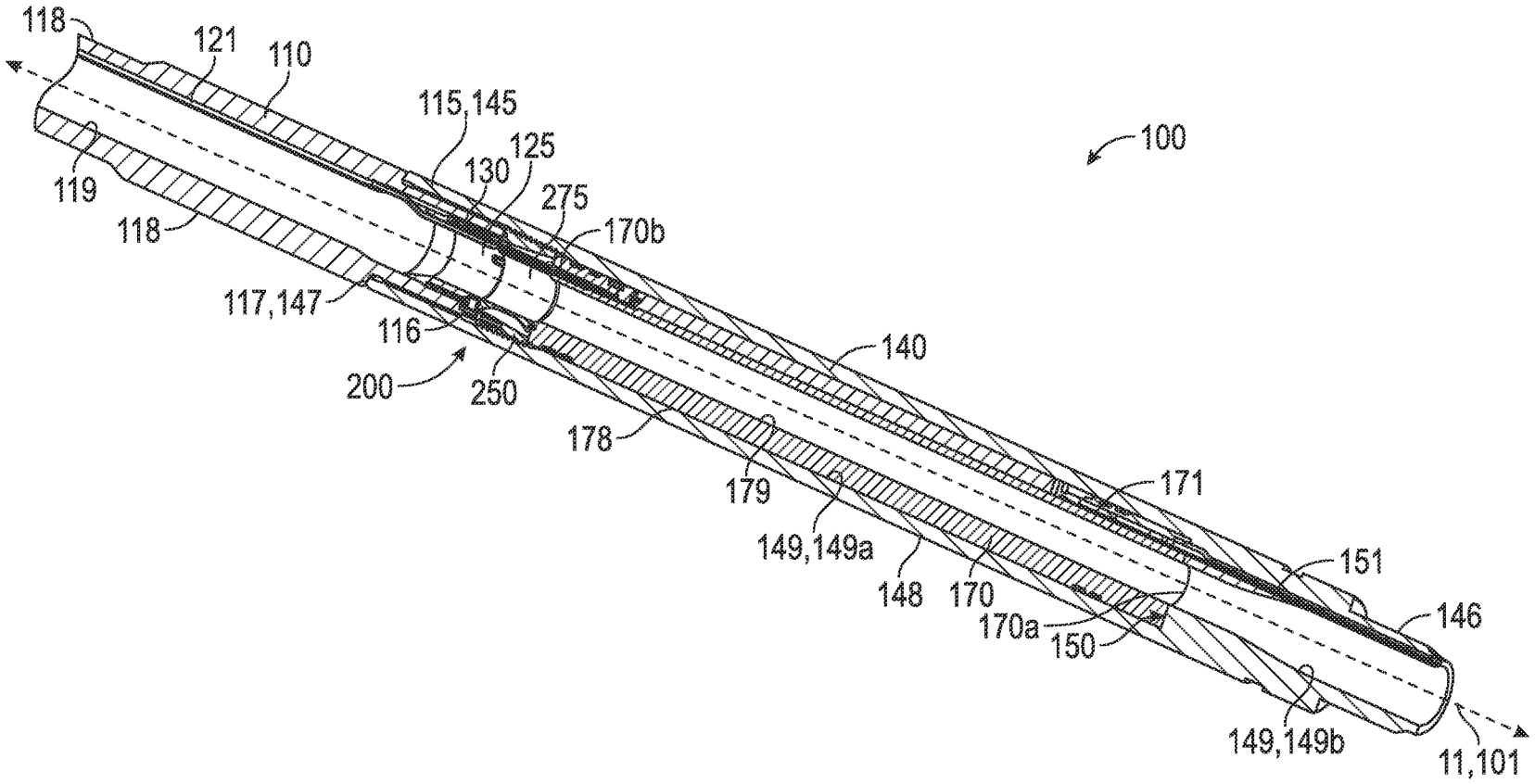
FIG. 2 is a partial cross-sectional schematic view of an embodiment of a downhole sub assembly in accordance with the principles described herein.
Figure 3:
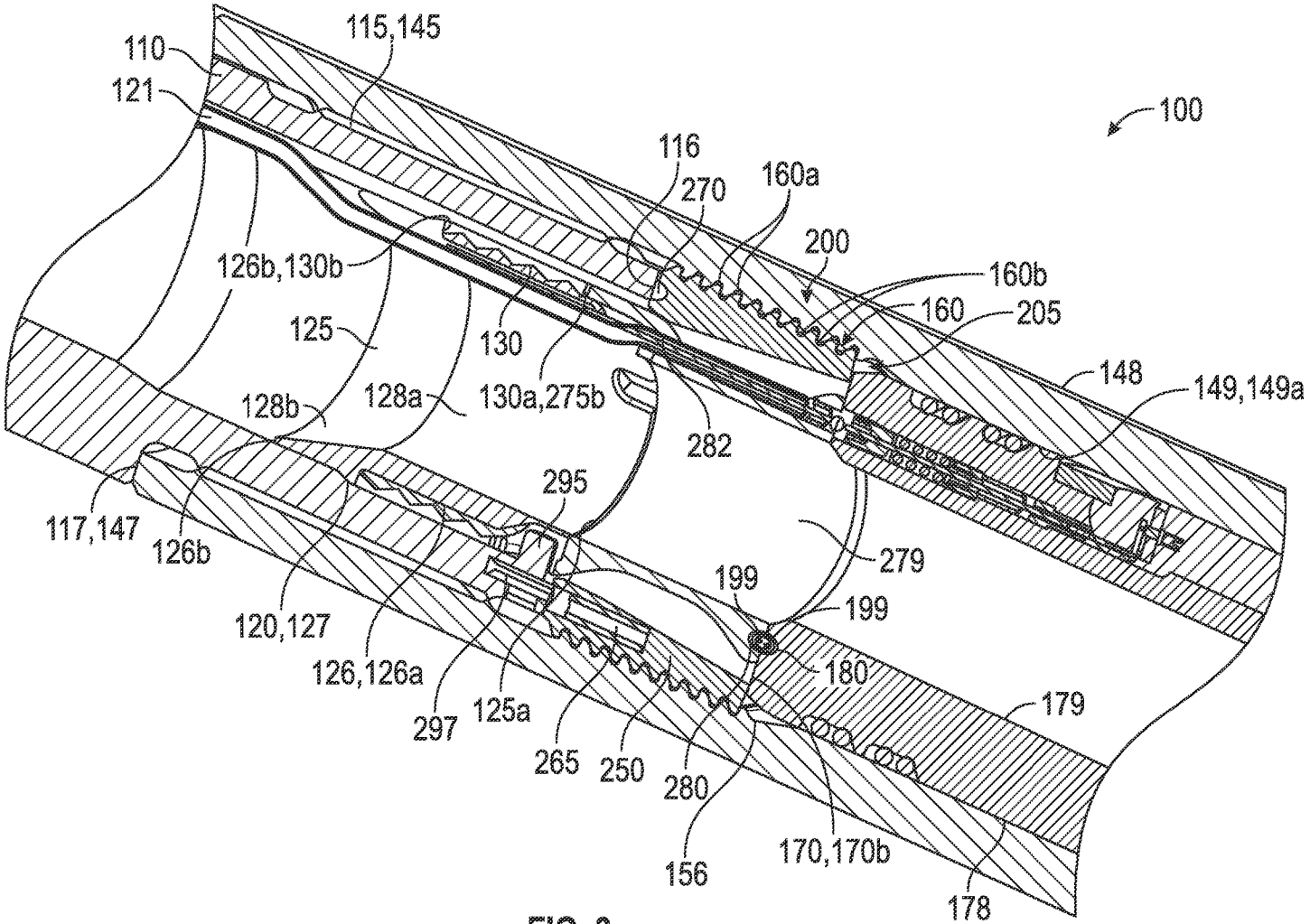
FIG. 3 is an enlarged cross-sectional schematic view of the downhole sub assembly of FIG. 2.

Referring to FIGS. 1 through 3, a node 30 (FIG. 1) is integrated into a downhole sub assembly 100 (FIG. 2) having a central axis 101 coaxial with drillstring central axis 11. The downhole sub assembly 100 comprises a first housing 110, a second housing 140, an electronics housing 170, and a stabilizer assembly 200. The first housing 110 is tubular and has a threaded pin end 115 opposite a threaded box end (not shown), a generally cylindrical outer surface 118, a generally cylindrical inner surface 119 having an angled shoulder 120 (see FIG. 3), a tubular passage 121 disposed between the outer and inner surfaces 118, 119, respectively, a spring cap 125, and a biasing element 130. The threaded pin end 115 includes an internal shoulder 116 and an external shoulder 117. The first housing or first tubular housing 110 may be made of any suitable material known in the art including, but not limited to, metals.

Referring now to FIG. 3, spring cap 125 is tubular having a first annular end 125*a* opposite a second annular end 125*b*, an external cutout 126 forming an outer cylindrical surface 126*a* and a shoulder 126*b*, an outer angular shoulder 127, and an inner cylindrical surface 128*a* with a tapered end 128*b*. Spring cap 125 is configured to be disposed in the cylindrical inner surface 119 of the first tubular housing 110 at the pin end 115 such that the first annular end 125*a* of spring cap 125 is proximate internal shoulder 116 of first tubular housing 110 and the angled shoulder 127 engages the angled shoulder 120 of cylindrical inner surface 119 of first tubular housing 110. Spring cap 125 may be made of any suitable material known in the art including, but not limited to, metals.

Referring still to FIG. 3, biasing element 130 has a first axial end 130*a* opposite a second axial end 130*b* and is disposed between outer cylindrical surface 126*a* of spring cap 125 and the inner cylindrical surface 119 of first tubular housing 110. The second axial end 130*b* of biasing element 130 is configured to engage the spring cap shoulder 126*b* and the biasing element first axial end 130*a* is configured to engage the spacer 275 (to be described in more detail below). Biasing element 130 may be any type of biasing element known in the art including, but not limited to, springs and circumferential pieces of metal having angled surfaces.

Figure 6:
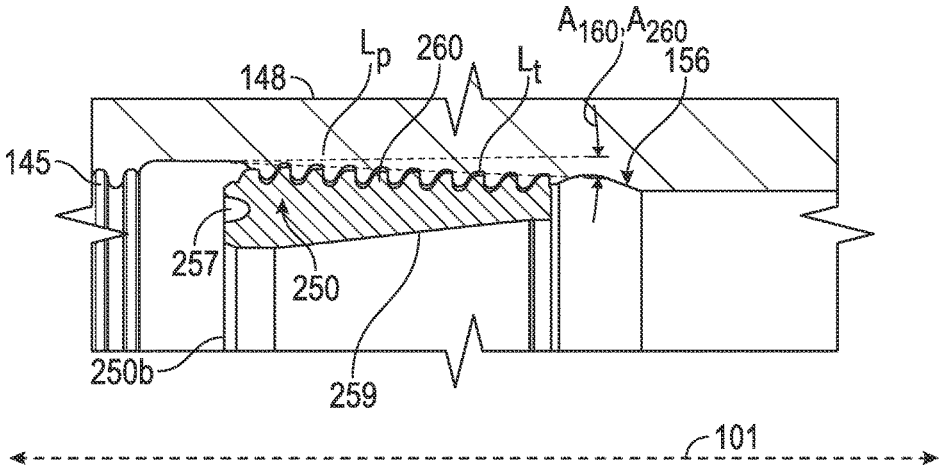
FIG. 6 is an enlarged cross-sectional schematic view of a portion of the downhole sub assembly of FIG. 5.

Referring now to FIGS. 2 and 3, the second housing 140 is tubular and has a threaded box end 145 opposite a threaded pin end 146; a generally cylindrical outer surface 148; an inner surface 149 having a stress relief groove 156 (see also FIG. 6), a generally cylindrical portion 149*a*, an internal shoulder 150, and an angled portion 149*b* extending axially from the shoulder 150; and a tubular passage 151 disposed between the outer and inner surfaces 148, 149, respectively. The threaded box end 145 includes an external shoulder 147.

The first housing pin end 115 is configured to threadingly engage the second housing box end 145, such that first housing external shoulder 117 engages and is torqued against second housing external shoulder 147. Cylindrical portion 149*a* comprises a plurality of grooves 160 disposed proximate second housing threaded box end 145, wherein each groove 160 comprises an individual curved channel 160*a* separated by a peak 160*b*—grooves 160 are not threaded and do not comprise a continuous helical path. Each successive groove 160 from the second housing box end 145 toward the pin end 146 is disposed radially closer to central axis 101, forming a taper angle $A_{160}$ (see FIG. 6) as measured between a line $L_p$ parallel to central axis 101 and a line $L_t$ tangential to each groove channel 160*a*. Thus, grooves 160 are disposed in a tapered profile having a taper angle $A_{160}$. Second tubular housing 140 may be made of any suitable material known in the art including, but not limited to, metals. In other embodiments, grooves 160 may be supplemented or replaced with other interlocking or frictional interfaces known in the art including, but not limited to, ratchet teeth, adhesives, pins, lugs and slots, and others.

Referring still to FIGS. 2 and 3, the electronics housing 170 is tubular and has a first annular end 170*a* opposite a second annular end 170*b*, an outer cylindrical surface 178, an inner cylindrical surface 179, and a tubular passage 171 disposed between the outer and inner surfaces 178, 179, respectively.

The electronics housing 170 is configured to be disposed in the second housing 140 such that electronics housing first annular end 170*a* engages second housing internal shoulder 150 and the tubular passages 171, 151 of the electronics housing 170 and second housing 140, respectively, are aligned. Further, when electronics housing 170 is disposed in the second housing 140, electronics housing outer cylindrical surface 178 is coaxial with and may contact cylindrical portion 149*a* of second housing inner surface 149 while electronics housing inner cylindrical surface 179 forms a continuous inner surface with angled portion 149*b* of second housing inner surface 149 (see FIG. 2). When disposed in second tubular housing 140, the electronics housing second annular end 170*b* forms an internal shoulder and may, thus, be referred to as shoulder 170*b* or first annular end 170*b*. Shoulder 170*b* includes an annular channel 180 configured to accept a coupler element 199 (see FIG. 3). Tubular electronics housing 170 may be made of any suitable material known in the art including, but not limited to, metals. Coupler element 199 may be any coupler element known in the art including, but not limited to, inductive coupler elements, conductive coupler elements, and other two-part, separable components with electrical communication therebetween. In some embodiments, the coupler element 199 includes two mating components for the transfer of power and/or data. In some embodiments, the two mating components communicate inductively, through direct electrical contact, optically, or combinations thereof.

Figure 4:
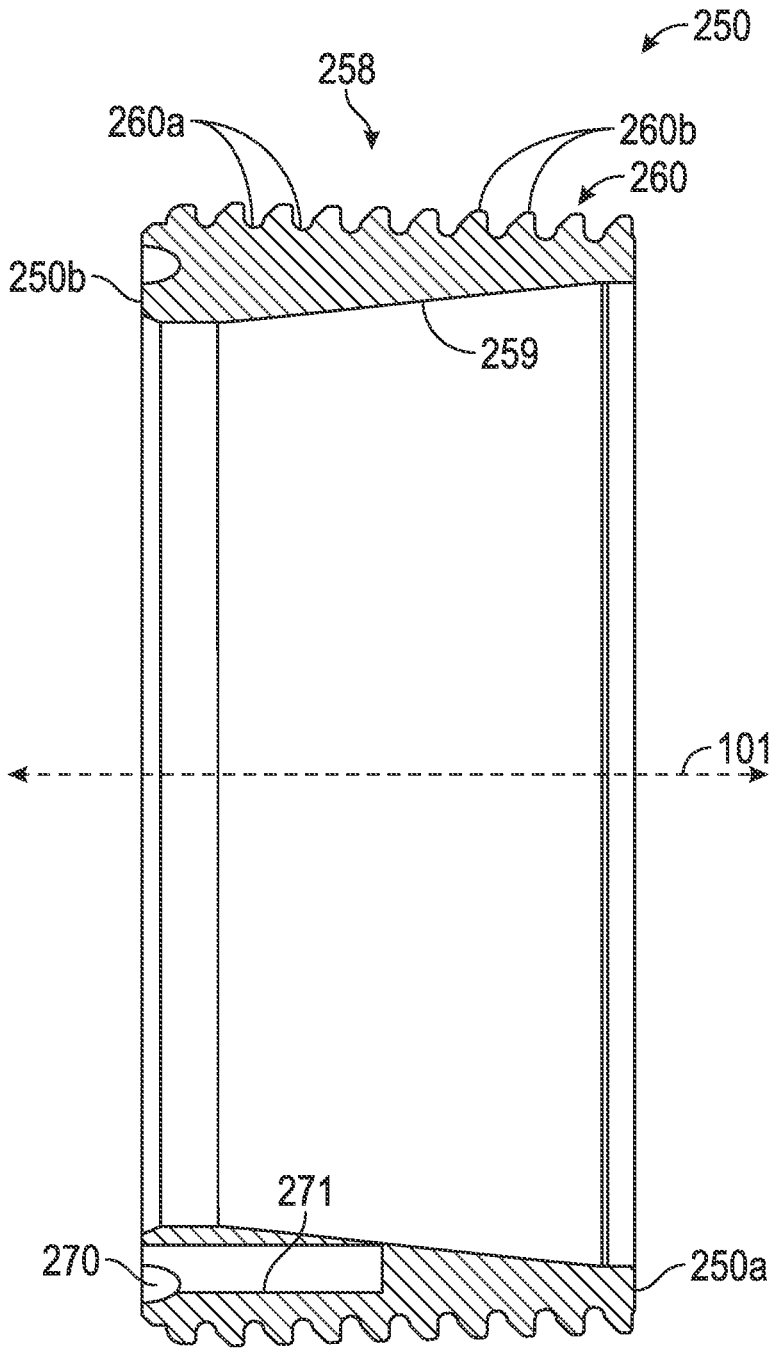
FIG. 4 is a cross-sectional view of a sleeve shown in the downhole sub assembly of FIG. 2.

Referring now to FIGS. 3 and 4, the sleeve 250 is generally tubular and has a first annular end 250*a* opposite a second annular end 250*b*, an inner frustoconical surface 259, an outer frustoconical surface 258 having a plurality of grooves 260 extending from sleeve first annular end 250*a* to sleeve second annular end 250*b*, and a plurality of circumferentially spaced bores 271, 272, 273 configured to engage dowel pins 265. Second annular end 250*b* includes a channel or groove 270. Each groove 260 comprises an individual curved channel 260*a* separated by a peak 260*b*—grooves 260 are not threaded and do not comprise a continuous helical path. Each successive groove 260 from the sleeve second annular end 250*b* toward the first annular end 250*a* is disposed radially closer to central axis 101, forming a taper angle $A_{260}$ (see FIG. 6) as measured between a line $L_p$ parallel to central axis 101 and a line $L_t$ tangential to each groove peak 260*b*. Thus, grooves 260 are disposed in a tapered profile having a taper angle $A_{260}$. The taper angle $A_{160}$ of grooves 160 in the second housing 140 is preferably equal to or substantially similar to the taper angle $A_{260}$ of grooves 260 in the sleeve 250. Sleeve housing 140 may be made of any suitable material known in the art including, but not limited to, metals. In other embodiments, grooves 260 may be supplemented or replaced with other interlocking or frictional interfaces known in the art including, but not limited to, ratchet teeth, adhesives, pins, lugs and slots, and others.

Figure 5:
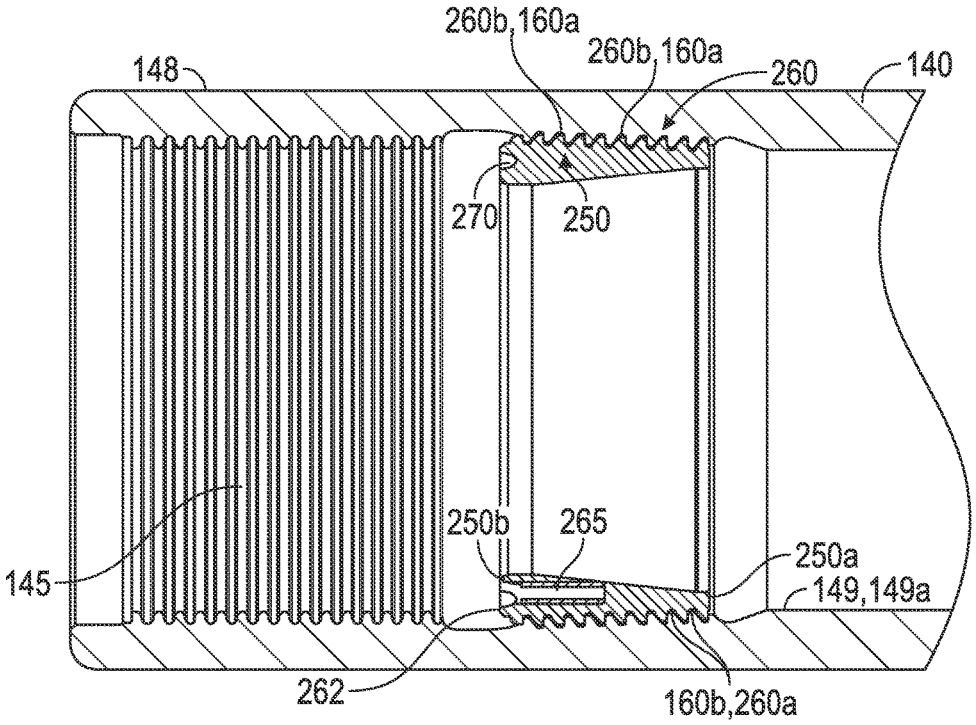
FIG. 5 is a cross-sectional schematic view of a portion of the downhole sub assembly of FIG. 2.

Referring now to FIGS. 3 and 5, the sleeve 250 is configured to be disposed in the second housing 140 such that sleeve first annular end 250*a* is proximate electronics housing internal shoulder 170*b*; however, the sleeve 250 and the electronics housing 170 do not contact one another, instead, the sleeve 250 is separated from the electronics housing 170 by a gap 205. In addition, when the sleeve 250 is disposed in the second housing 140, the sleeve second annular end 250*b* engages the internal shoulder 116 of pin end 115, and sleeve grooves 260 matingly engage second housing grooves 160. More specifically, the sleeve groove peaks 260*b* engage second housing groove valleys 160*a* and the sleeve groove valleys 260*a* engage second housing groove peaks 160*b*. Further, when disposed in second tubular housing 140, the second annular end 250*b* of sleeve 250 forms an internal shoulder and may, thus, be referred to as shoulder 250*b* or second annular end 250*b*. The first housing pin end 115 is configured to threadingly engage the second housing box end 145, such that first housing internal shoulder 116 engages and is torqued against sleeve shoulder 250*a*.

Figure 7A:
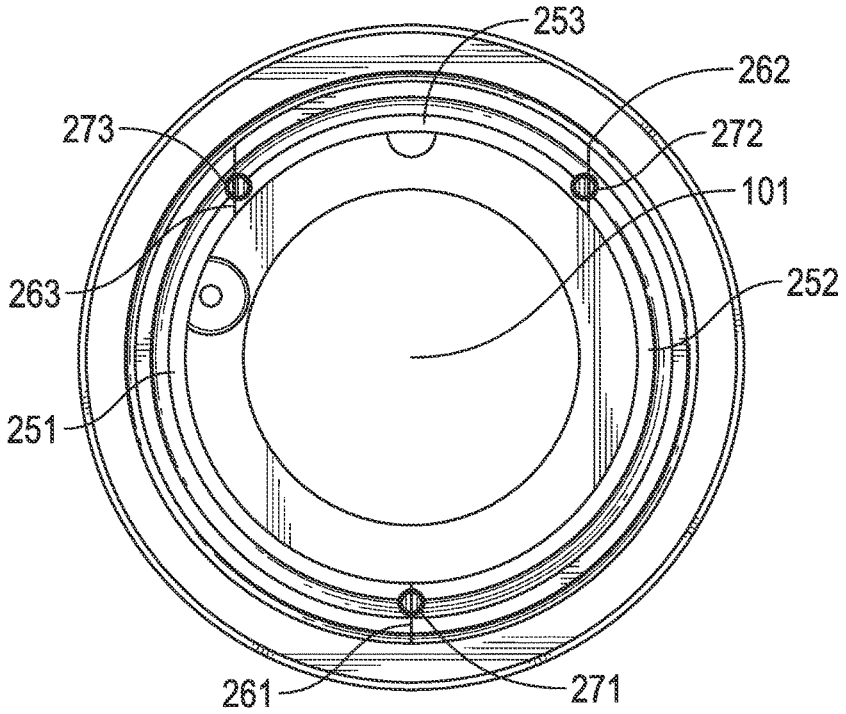
FIG. 7A is a schematic front view of a portion of the downhole sub assembly of FIG. 2.
Figure 7B:
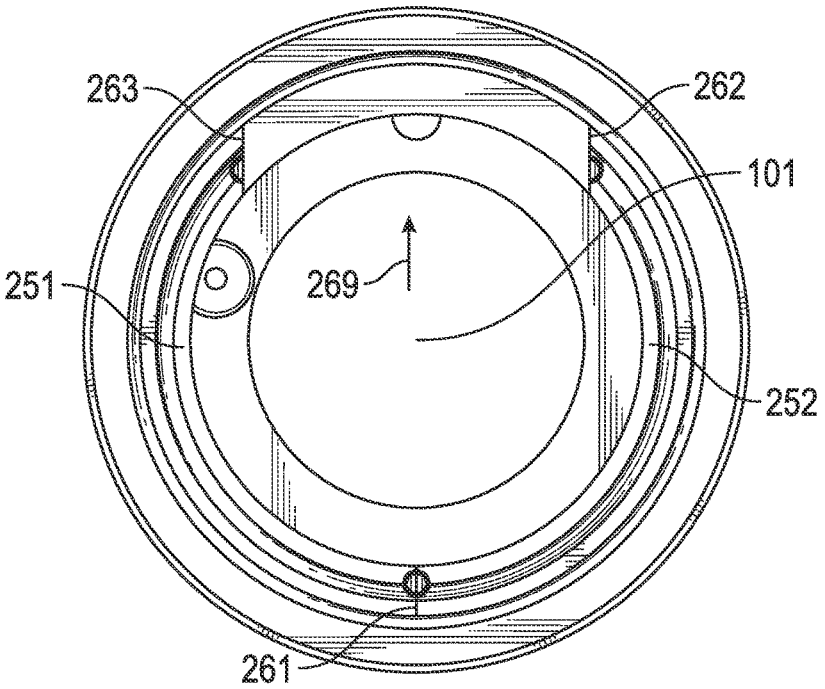
FIG. 7B is a schematic front view of a portion of the downhole sub assembly of FIG. 7A.

Referring now to FIGS. 5, 7A, and 7B, an embodiment of sleeve 250 further comprises a first, second, and third through bore 271, 272, 273, respectively, and a first, second, and third section 251, 252, 253, respectively, to aid in assembly and installation of sleeve 250 into the second housing 140. As previously described, grooves 260 (and mating grooves 160 in the second housing 140) are not threaded and do not comprise a continuous helical path, and therefore, cannot be installed through rotation as in a standard threaded engagement. Sleeve 250 is sectioned in three locations such that a first, second, and third section cut 261, 262, 263, respectively, runs through corresponding first, second, and third through bores 271, 272, 273, respectively, and runs parallel to the remaining two section cuts 261, 262, 263. The first and second sections 251, 252, respectively, are inserted into second housing 140 and the second housing grooves 160 are engaged with the sleeve grooves 260, as shown in FIG. 7B. Next, the sleeve grooves 260 of the third section 253 are axially aligned along axis 101 with the housing grooves 160, and then the entire section is moved radially outward in direction 269 to form sleeve 250. Dowel pins 265 (see FIG. 5) are disposed in the through bores 271, 272, 273 to retain adjacent sections 251, 252, 253 at the section cuts 261, 262, 263 and thereby retain sleeve 250 in second housing 140. Though shown in the present embodiment with section cuts 261, 262, 263 oriented in the same direction, in other embodiments, varying combinations of angles may be used to allow ease of insertion of sleeve 250.

Figure 8:
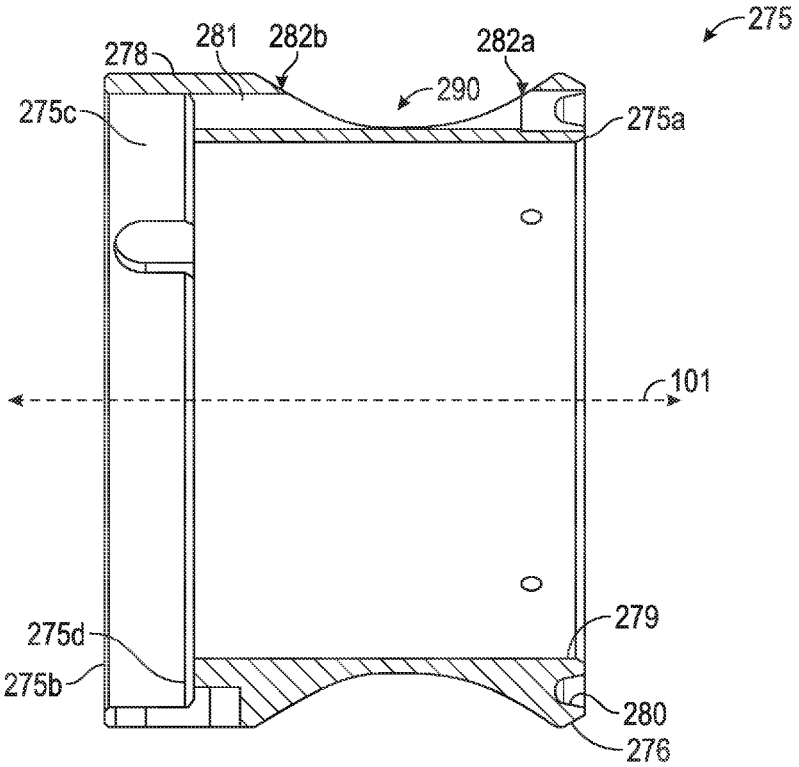
FIG. 8 is a cross-sectional view of a spacer shown in the downhole sub assembly of FIG. 2.
Figure 9:
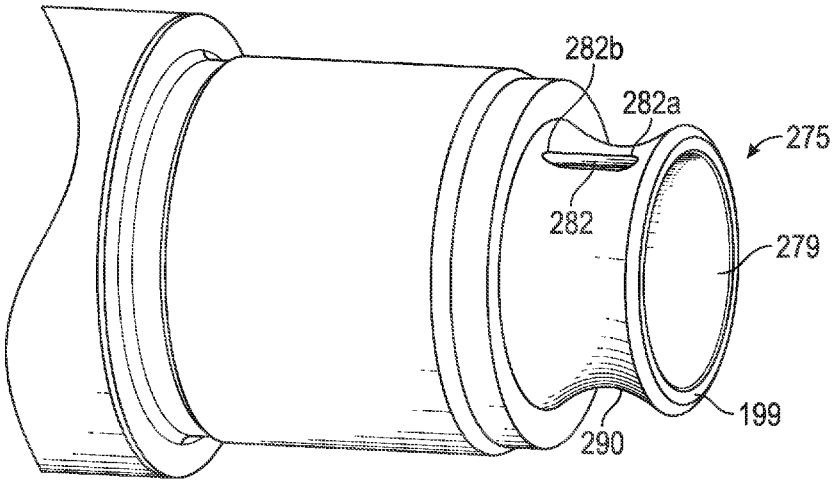
FIG. 9 is a schematic view of a portion of the downhole sub assembly of FIG. 2.

Referring now to FIGS. 3 and 8, the spacer 275 is generally tubular and has a first annular end 275*a* opposite a second annular end 275*b* having a counterbore 275*c* that forms an internal shoulder 275*d*, an inner cylindrical surface 279, an outer surface 278 having a cutout 290, and a tubular passage 281 disposed between the outer and inner surfaces 278, 279, respectively. First annular end 275*a* comprises a chamfer 276 for alignment purposes and an annular channel 280 configured to accept a coupler element 199 (see FIG. 3). Cutout 290 is generally curved having a semi-circular cross-section as shown in FIG. 8. Cutout 290 exposes a portion of tubular passage 281, and consequently exposes a portion of a tube 282 (see FIGS. 3 and 9) inserted into the tubular passage 281. The tube 282 is welded to the outer surface 278 of the spacer 275 at anchor points 282*a*, 282*b* (see FIG. 9). The tube 282 may be any type of tubing standard in the art including, but not limited to, dagger protection tubing.

Figure 11:
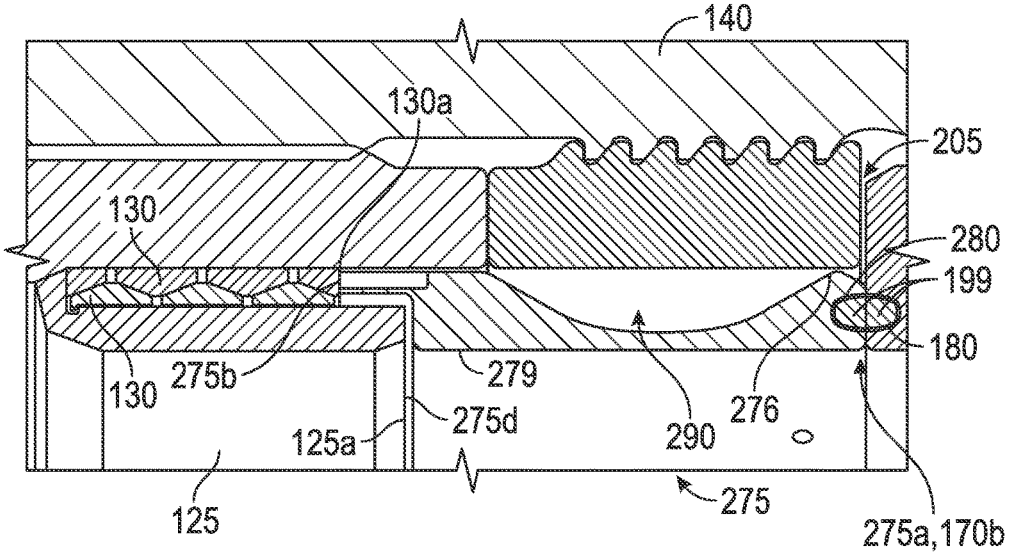
FIG. 11 is an enlarged cross-sectional schematic view of a portion of the downhole sub assembly of FIG. 10.

Referring now to FIGS. 3 and 11, the spacer 275 is configured to be disposed in the second housing 140 such that spacer first annular end 275*a* engages electronics housing internal shoulder 170*b*, spacer second annular end 275*b* engages the first axial end 130*a* of biasing element 130, and spacer counterbore 275*c* engages the first annular end 125*a* of spring cap 125. Further, spacer first annular end 275*a* is configured to engage electronics housing internal shoulder 170*b* such that the annular channel 280 of spacer 275 is aligned with the annular channel 180 of electronics housing 170 and the coupler element 199 in spacer channel 280 contacts the mating coupler element 199 in electronics housing channel 180. Spacer 275 is coaxial with electronics housing 170 and spacer inner cylindrical surface 279 forms a continuous inner surface with electronics housing inner cylindrical surface 179 (see FIG. 2). When spacer 275 is disposed in the second housing 140, the second annular end 275*b* of spacer 275 is configured to retain biasing element 130 between the cylindrical inner surface 119 of the first housing 110 and the outer cylindrical surface 126*a* and shoulder 126*b* of the spring cap 125. Spacer 275 is further configured to be disposed within the inner frustoconical surface 259 of sleeve 250; however, contact between the spacer 275 and the sleeve 250 is minimal.

Figure 12:
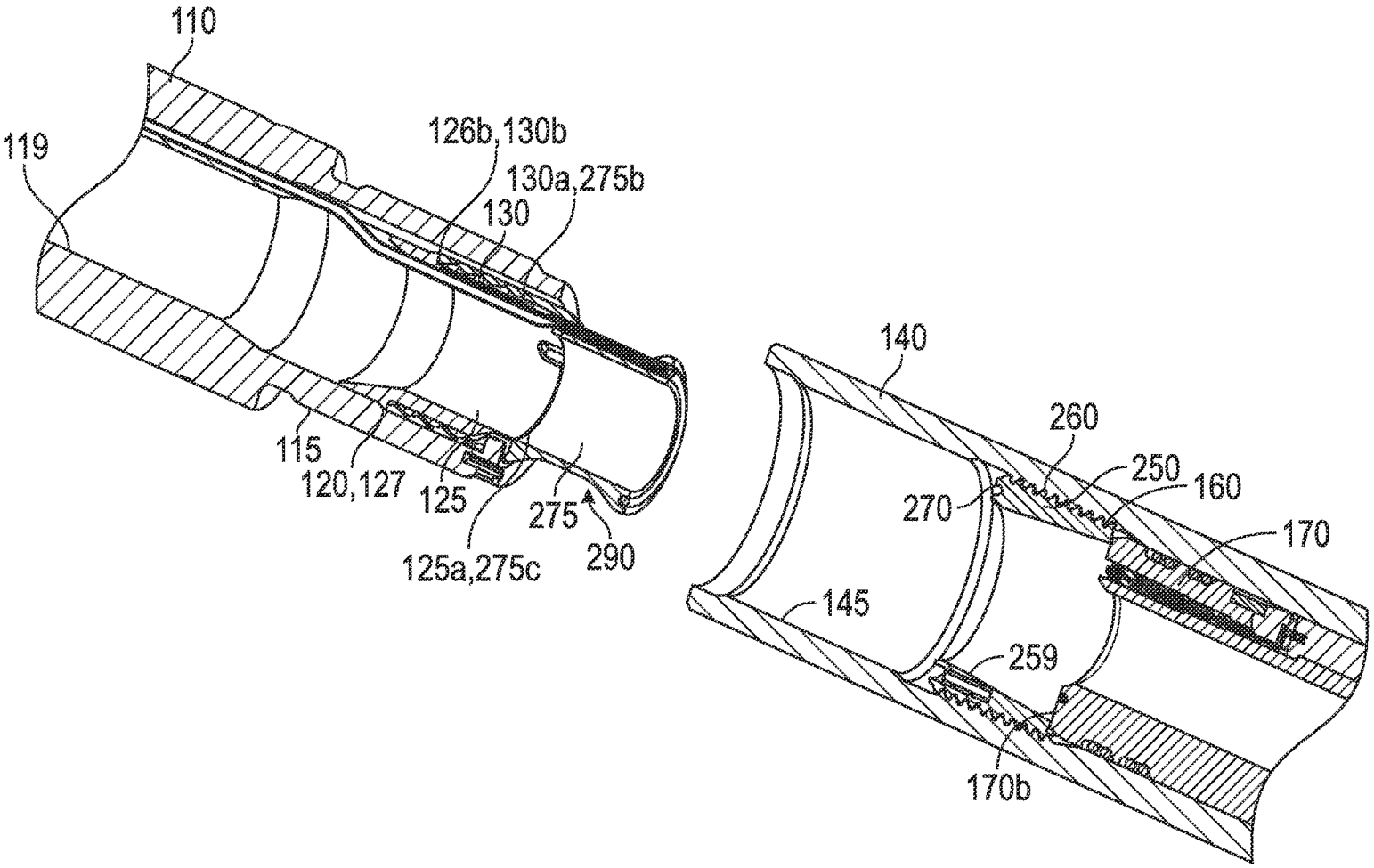
FIG. 12 is a partial exploded cross-sectional schematic view of the downhole sub assembly of FIG. 2.

Referring now to FIG. 12, before the first housing 110 is mated with the second housing 140, the electronics housing 170 is installed in the second housing 140, forming an internal shoulder 170*b*. The sleeve 250 is then installed in second housing 140 in three sections 251, 252, 253 as previously described, such that sleeve grooves 260 having a tapered profile engage second housing grooves 160 having a complementary (opposite) tapered profile—the sleeve groove peaks 260*b* engage second housing groove valleys 160*a* and the sleeve groove valleys 260*a* engage second housing groove peaks 160*b*.

Figure 10:
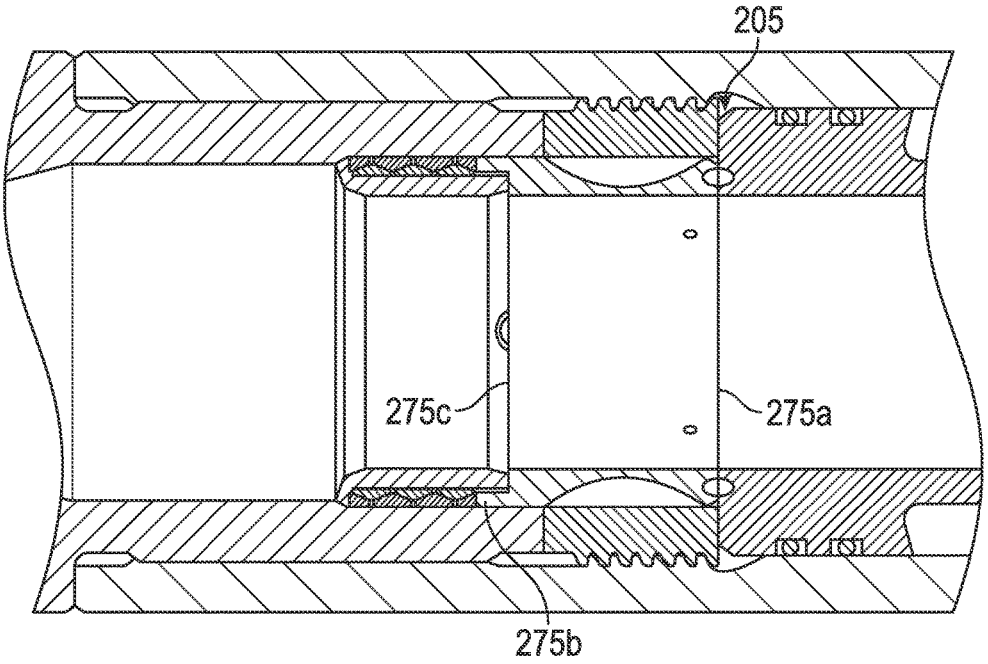
FIG. 10 is a cross-sectional schematic view of a portion of the downhole sub assembly of FIG. 2.

Referring still to FIG. 12, the spring cap 125 with biasing element 130 is inserted into the first housing 110 such that the spring cap angled shoulder 127 engages the angled shoulder 120 of cylindrical inner surface 119 of first tubular housing 110, and the second axial end 130*b* of biasing element 130 engages the spring cap shoulder 126*b*. The spacer 275 is installed in first housing 110 such that spacer second annular end 275*b* engages the first axial end 130*a* of biasing element 130, and spacer counterbore 275*c* engages the first annular end 125*a* of spring cap 125. Spacer 275 is retained in first housing 110 with a retention pin 295 disposed proximate spacer counterbore 275*c* (see FIGS. 3 and 10). The retention pin 295 is further held in place by a roll pin 297 disposed orthogonal to the retention pin 295 (see FIG. 3). The retention pin 295 is the more vertical component and the roll pin is the smaller, more horizontal item.

The first housing 110 pin end 115 with spring cap 125, biasing member 130, and spacer 250 are inserted into second housing 140 box end 145 with electronics housing 170 and sleeve 250 and then rotated about axis 101 to mate the threaded pin end 115 and threaded box end 145. However, inserting the spacer 275 (with first housing 110, spring cap 125, and biasing element 130) into the sleeve 250 (with second housing 140 and electronics housing 170) is a blind process. The tapered chamfer 276 in spacer 275 reduces potential interference with and allows for proper alignment during insertion of the spacer 275 into the sleeve 250. In addition, tube 282 in tubular passage 281 of the spacer 275 is anchored at both ends 282*a*, 282*b* to reduce potential damage to the tubing 282. First annular end 275*a* is also roughened to reduce the possibility of galling by allowing thread dope to accumulate on first annular end 275*a*.

The sleeve 250 allows for the maintenance of load sharing and torquing capability in the threaded connection and sub assembly 100 by using the sleeve 250 and its shoulder 250*b* to functionally replace the secondary shoulder (i.e., internal shoulder 170*b* of electronics housing 170) of a double shouldered drill pipe threaded connection (i.e., the mating of first housing 110 and second housing 140). More specifically, the sleeve 250, 250*b* acts as the secondary shoulder and the features of the sleeve 250—the tapered groove profile of grooves 160, 260 combined with the inner frustoconical surface 259 of sleeve 250, the channel 270 in second annular end 250*b* of sleeve 250, and the stress relief groove 156 in second housing 140—help make load sharing more uniform across the entire length of the grooves 160,

260, which reduces the stress riser typically seen at the first three threads of a threaded connection. In this manner, the sleeve 250 and its shoulder 250*b* provide the robust surface for the torquing capability that the internal shoulder 170*b* of the electronics housing 170 may not be able to provide.

The spacer 275 allows for the constant contact of a coupler element (i.e., coupler element 199 disposed in channel 180 of the electronics housing shoulder 170*b* and coupler element 199 disposed in channel 280 of the spacer first annular end 275*a*) to ensure continuity of electrical signal under pressure up to 25,000 psi and dynamic loads. Under a 25,000 psi pressure load, the electronics housing 170 tends to compress axially an amount greater than the coupler element 199 would allow if the coupler were not moveable. Thus, maintaining connectivity of the coupler elements 199 in the spacer 275 and electronics housing 170 under high pressure is achieved by the biasing force of the biasing element 130 under load in combination with the cutout 290 of spacer 275, which lowers the inertia of the spacer 275 by reducing its mass. When manufacturing the cutout 290 in spacer 275, the maximum amount of material is removed while maintaining mechanical integrity.

In some embodiments, when the sub assembly 100 is deployed downhole, pressure and temperature conditions can cause the electronics housing 170 to shrink or pull back axially, thus causing the shoulder 170*b* and the corresponding coupler element 199 to pull away from the mating coupler element 199 in the annular end 275*a*. The spacer 275 is biased by the biasing element 130 such that the annular end 275*a* is forced axially toward the shoulder 170*b*, thereby maintain contact of the coupler elements 199 despite the moveability of the shoulder 170*b*. Because of the moveability or variable position of the shoulder 170*b*, shoulder 170*b* also does not provide a good torquing surface for a robust torquing interface. Thus, the sleeve 250 and its shoulder 250*b* are provided as described above to functionally replace the shoulder 170*b* with a shoulder that provides good torquing capability, in an axially displaced location from the shoulder 170*b*.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order, and disclosed features and components can be arranged in any suitable combination to achieve desired results.

What is claimed is:

1. A downhole sub comprising:

a first tubular housing with a first internal shoulder;

a second tubular housing with a second internal shoulder; and a stabilizer assembly to be disposed between the first and second internal shoulders and comprising an outer sleeve and an inner spacer, wherein the inner spacer comprises an annular cutout formed on an outer cylindrical surface of the inner spacer;

wherein the first and second tubular housings are configured to be threaded together;

wherein the stabilizer assembly is configured to engage the first and second internal shoulders.

2. The downhole sub of claim 1, wherein the outer sleeve comprises a first end opposite a second end, wherein the first end is disposed proximate the second internal shoulder of the second housing.

3. The downhole sub of claim 2, wherein the second end of the outer sleeve forms a third internal shoulder.

4. The downhole sub of claim 3, wherein the first internal shoulder is configured to engage the third internal shoulder.

5. The downhole sub of claim 4, wherein the engagement of the first internal shoulder and the third internal shoulder provides a torquing interface between the first and second tubular housings.

6. The downhole sub of claim 5, wherein the second internal shoulder is disposed on a tubular electronics housing inserted into an annulus of the second tubular housing, the tubular electronics housing being susceptible to axial shrinkage.

7. The downhole sub of claim 6, wherein the tubular electronics housing is moveable.

8. The downhole sub of claim 7, wherein the inner spacer is biased to maintain engagement with the second internal shoulder as the tubular electronics housing moves.

9. The downhole sub of claim 8, wherein the maintained engagement of the inner spacer and the second internal shoulder as the tubular electronics housing moves, further maintains engagement of a first coupler element disposed on the inner spacer and a second coupler element disposed on the second internal shoulder of the tubular electronics housing.

10. A downhole sub comprising:

a first tubular housing with a first internal shoulder;

a second tubular housing with a second internal shoulder; and a sleeve to be disposed between the first and second internal shoulders, wherein the sleeve comprises a plurality of interlocking interfaces disposed in a tapered profile having a taper angle relative to a longitudinal axis of the sleeve;

wherein the first and second tubular housings are configured to be threaded together;

wherein the sleeve is configured to engage the first internal shoulder.

11. The downhole sub of claim 10, wherein the sleeve comprises a first end opposite a second end, wherein the first end is disposed proximate the second internal shoulder of the second housing.

12. The downhole sub of claim 11, wherein the second end of the sleeve forms a third internal shoulder.

13. The downhole sub of claim 12, wherein the first internal shoulder is configured to engage the third internal shoulder.

14. The downhole sub of claim 13, wherein the engagement of the first internal shoulder and the third internal shoulder provides a torquing interface between the first and second tubular housings.

15. The downhole sub of claim 14, wherein the second internal shoulder is disposed on a tubular electronics housing inserted into an annulus of the second tubular housing, the tubular electronics housing being susceptible to axial shrinkage.

16. The downhole sub of claim 15, wherein the tubular electronics housing is moveable.

17. A downhole sub comprising:

a first tubular housing with a first internal shoulder;

a second tubular housing with a second internal shoulder; and a spacer having a first end that is biased and a second end configured to engage the second internal shoulder;

wherein the first and second tubular housings are configured to be threaded together;

wherein the second internal shoulder is disposed on a tubular electronics housing inserted into an annulus of the second tubular housing, the tubular electronics housing being susceptible to axial shrinkage.

18. The downhole sub of claim 17, wherein the tubular electronics housing is moveable.

19. The downhole sub of claim 18, wherein the spacer is biased to maintain engagement with the second internal shoulder as the tubular electronics housing moves.

20. The downhole sub of claim 19, wherein the maintained engagement of the spacer and the second internal shoulder as the tubular electronics housing moves, further maintains engagement of a first coupler element disposed on the spacer and a second coupler element disposed on the second internal shoulder of the tubular electronics housing.

21. A stabilizer assembly for use with a downhole sub assembly, the stabilizer assembly comprising:

an outer sleeve having a plurality of interlocking interfaces;

an inner spacer having a first annular end opposite a second annular end, a cutout and a coupler element disposed in a channel on a the first annular end; and a biasing assembly comprising a biasing element and disposed about and retained by a first end of a spring cap;

wherein the inner spacer is configured to engage and retain the biasing element at a second annular end of the spring cap.

22. The stabilizer assembly of claim 21, wherein the plurality of interlocking interfaces is disposed in a tapered profile having a taper angle relative to a longitudinal axis of the outer sleeve.

23. The stabilizer assembly of claim 22, wherein the outer sleeve provides a torquing interface.

24. The stabilizer assembly of claim 23, wherein the inner spacer is moveable.

25. The stabilizer assembly of claim 24, wherein the inner spacer moves independently from the outer sleeve.

26. A method of coupling tubular housings in a downhole sub comprising:

threadably coupling a first tubular housing and a second tubular housing, wherein the first tubular housing includes a first shoulder and the second tubular housing includes a second shoulder;

interlocking a sleeve with and inside the second tubular housing at a plurality of interlocking interfaces disposed in a tapered profile having a taper angle relative to a longitudinal axis of the sleeve, the sleeve disposed between the first and second shoulders and including a third shoulder; and torquing the first shoulder against the third shoulder.

27. The method of claim 26 further comprising a spacer disposed between the first tubular housing and the second shoulder, and biasing the spacer toward the second shoulder to maintain contact between the spacer and the second shoulder.

* * * * *